US006669329B2

(12) United States Patent
Bailey et al.

(10) Patent No.: US 6,669,329 B2
(45) Date of Patent: Dec. 30, 2003

(54) PRINTER HAVING ONE OR MORE PRINT CARTRIDGES INSTALLED DURING MANUFACTURE

(75) Inventors: Thomas Allen Bailey, Frankfort, KY (US); David Vincent Iorio, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/190,952

(22) Filed: Jul. 8, 2002

(65) Prior Publication Data

US 2002/0175978 A1 Nov. 28, 2002

Related U.S. Application Data

(63) Continuation of application No. 09/916,572, filed on Jul. 27, 2001, now Pat. No. 6,443,553, which is a continuation-in-part of application No. 09/375,086, filed on Aug. 16, 1999, now Pat. No. 6,350,010.

(60) Provisional application No. 60/266,611, filed on Feb. 6, 2001.

(51) Int. Cl.[7] ..... B41J 23/00; B41J 29/13

(52) U.S. Cl. ..... 347/37; 347/108

(58) Field of Search ..... 347/37, 108, 29, 347/22, 49; 400/319, 320, 337, 341, 352, 277, 301, 356, 691, 680, 683

(56) References Cited

FOREIGN PATENT DOCUMENTS

| | | | |
|---|---|---|---|
| JP | 05-155091 | * | 6/1993 |
| JP | 06-199006 | * | 7/1994 |

* cited by examiner

*Primary Examiner*—Judy Nguyen
(74) *Attorney, Agent, or Firm*—Stevens & Showalter, L.L.P.

(57) ABSTRACT

A printer is provided that allows one or more print cartridges to be installed during printer manufacture with little risk of ink evaporation during shipping so as to eliminate assembly problems associated with installation of print cartridges during initial printer setup.

17 Claims, 8 Drawing Sheets

PRINTER HAVING ONE OR MORE PRINT CARTRIDGES INSTALLED DURING MANUFACTURE

CROSS-REFERENCE TO RELATED APPLICATIONS

This application is a continuation of U.S. patent application Ser. No. 09/916,572, filed Jul. 27, 2001 now U.S. Pat. No 6,443,553, and entitled "A PRINTER HAVING ONE OR MORE PRINT CARTRIDGES INSTALLED DURING MANUFACTURE," which is a continuation-in-part of and claimed priority to U.S. patent application Ser. No. 09/375,086, filed Aug. 16, 1999 and entitled "A PRINTER HAVING ONE OR MORE PRINT CARTRIDGES INSTALLED DURING MANUFACTURE," now U.S. Pat. No. 6,350,010 B1, and further claimed the benefit of U.S. Provisional Application Serial No. 60/266,611, filed Feb. 6, 2001, and entitled "A PRINTER HAVING ONE OR MORE PRINT CARTRIDGES INSTALLED DURING MANUFACTURE"; this application claims priority to each of the above-identified applications; and the disclosures of each of the above-identified applications are incorporated herein by reference.

FIELD OF THE INVENTION

This invention relates to a printer having one or more print cartridges installed during manufacture so as to avoid installation of the one or more print cartridges by the user during initial printer setup.

BACKGROUND OF THE INVENTION

Typically, new ink jet printers are shipped from the manufacturer without a print cartridge installed in the printer. After the printer is purchased by an end user, the user removes it from the shipping package and performs one or more setup steps in accordance with an initial setup procedure. At some point during the setup procedure, one or more print cartridges are installed into the printer. The installation of print cartridges has been found to be problematic for many end users. For example, seals provided over printheads to prevent ink evaporation or leakage during shipment of print cartridges are oftentimes not removed prior to print cartridge installation. If the seal remains over the printhead after the print cartridge is installed, the printer will be unable to eject ink onto a substrate. Other users who do remove the seals manage to damage the print cartridge during seal removal.

It would be desirable to provide an arrangement that allows one or more print cartridges to be installed during printer manufacturing without risk of ink evaporation or leakage during shipping so as to eliminate initial assembly problems associated with installation of one or more print cartridges during initial printer setup.

SUMMARY OF THE INVENTION

This need is met by the present invention wherein a printer is provided that allows one or more print cartridges to be installed during printer manufacturing with little risk of ink evaporation or leakage during shipping so as to eliminate assembly problems associated with installation of print cartridges during initial printer setup.

In accordance with a first aspect of the present invention, a printer is provided comprising a housing having stationary and movable portions. The movable portion can be moved between first and second positions. A carrier is movably mounted within the housing. At least one print cartridge is mounted within the carrier. The printer further comprises a holding mechanism comprising a locking element adapted to engage the print cartridge when the movable housing portion is in its second position. The locking element disengages the print cartridge when the movable housing portion is in its first position. The locking element maintains the carrier and the print cartridge in a desired position within the housing when the locking element engages the print cartridge.

In accordance with a first embodiment of the present invention, the holding mechanism comprises a stationary arm fixedly mounted to the stationary housing portion, a cam fixedly mounted to the movable housing portion, and a lever pivotally coupled to the stationary arm. The lever defines the locking element. The cam effects movement of the lever when the movable housing portion moves to its second position such that the lever engages the print cartridge. The cam allows the lever to disengage the print cartridge when the movable housing portion is moved to its first position. The holding mechanism preferably further comprises a spring coupled to the stationary housing portion and the lever. The spring biases the lever to its disengaged position and the movable housing portion to its first position.

The movable housing portion comprises a first end pivotally coupled to the stationary housing portion, a second end located opposite the first end and a retainer at the second end. The retainer engages a section of the stationary housing portion so as to maintain the second end spaced a desired distance from the stationary housing portion when the movable housing portion is in its first position. In accordance with the first embodiment, the retainer is fixedly coupled to or integral with the second end of the movable housing portion. In accordance with a second embodiment of the present invention, the retainer is pivotally coupled to the second end of the movable housing portion. The pivotable retainer is adapted to releasably engage a latch fixedly coupled to the stationary housing portion so as to maintain the movable housing portion in its second position.

The housing further comprises a maintenance station. The carrier and the print cartridge are preferably located over the maintenance station when in the desired position.

In accordance with a second aspect of the present invention, a printer is provided comprising: a housing having a stationary portion and a movable portion movable between a first position and a second position; a cartridge assembly including a carrier movably mounted within the housing and at least one print cartridge removably mounted within the carrier; and a holding mechanism comprising a retaining arm fixedly coupled to the movable housing portion. The retaining arm engages the cartridge assembly when the movable housing portion is in its second position and disengages the cartridge assembly when the movable housing portion is in its first position. In one embodiment, the retaining arm engages the carrier when the movable housing portion is in its second position and disengages the carrier when the movable housing portion is in its first position. In another embodiment, the retaining arm engages the at least one print cartridge when the movable housing portion is in its second position and disengages the at least one print cartridge when the movable housing portion is in its first position.

In accordance with a third aspect of the present invention, a printer in combination with a packaging element is provided. The printer comprises a housing having stationary and movable portions. The movable portion can be moved between first and second positions. A carrier is movably mounted within the housing. At least one print cartridge is mounted within the carrier. The printer further comprises a holding mechanism comprising a locking element adapted to engage the print cartridge when the movable housing portion is moved to its second position. The locking element disengages the print cartridge when the movable housing portion is moved to its first position. The locking element maintains the carrier and the print cartridge in a desired position within the housing when the locking element engages the print cartridge. The packaging element engages the stationary and movable housing portions and maintains the movable housing portion in its second position when the packaging element is mounted to the printer.

In accordance with a fourth aspect of the present invention, a printer is provided comprising: a housing; a cartridge assembly including a carrier movably mounted within the housing and at least one print cartridge removably mounted within the carrier so as to move with the carrier; and a removable positioning element provided within the housing and engaging the cartridge assembly so as to maintain the cartridge assembly in a desired position within the housing. In a first embodiment, the positioning element engages the carrier so as to maintain the cartridge assembly in a desired position within the housing. In a second embodiment, the positioning element engages the print cartridge so as to maintain the cartridge assembly in a desired position within the housing. The positioning element is preferably formed from a material selected from the group consisting of cardboard, wood, metal, a polymeric material and combinations thereof.

An object of the present invention is to provide a printer wherein one or more print cartridges are installed during printer manufacture so as to eliminate the need for an end user to install the one or more print cartridges during initial printer setup.

Other objects will be readily perceived from the following description, claims, and drawings.

DETAILED DESCRIPTION OF PREFERRED EMBODIMENTS

An ink jet printer 10 constructed in accordance with a first embodiment of the present invention is shown in FIGS. 1–5. It comprises a housing 12 having stationary and movable portions 14 and 16. The housing portions 14 and 16 are preferably formed from a polymeric material such as polystyrene. Portion 16 is movable relative to portion 14 between a first position illustrated in FIGS. 3 and 5 and a second position illustrated in FIGS. 1 and 2.

Figure 3:
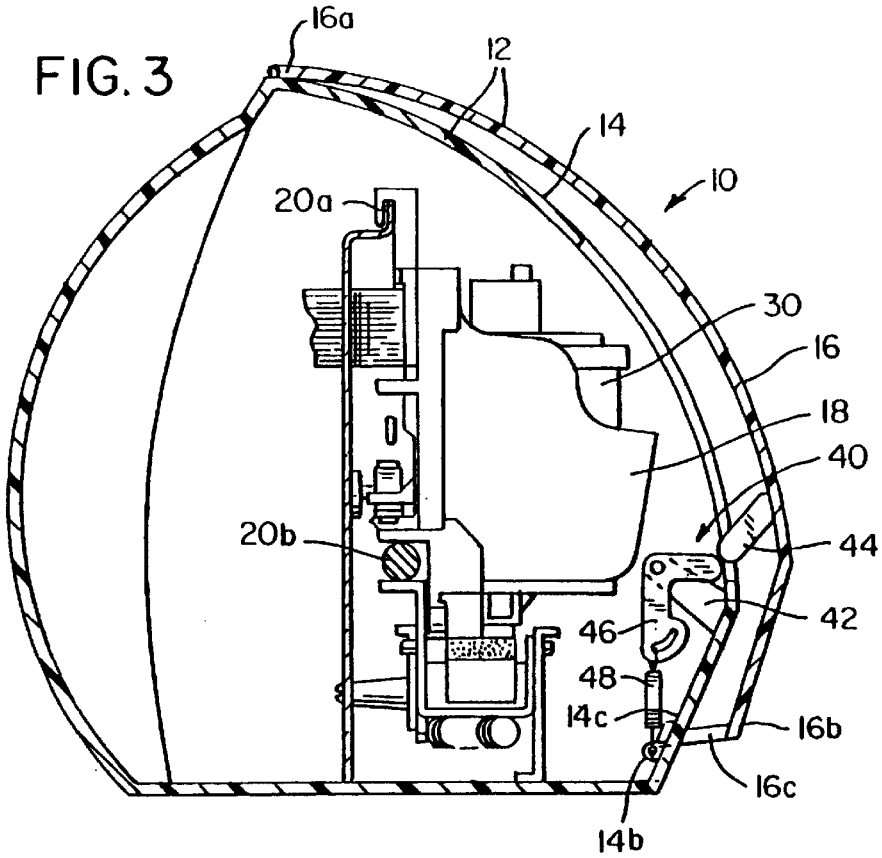
FIG. 3 is a sectional view of the printer illustrated in FIG. 1 with the movable housing portion shown in its first position.
Figure 4:
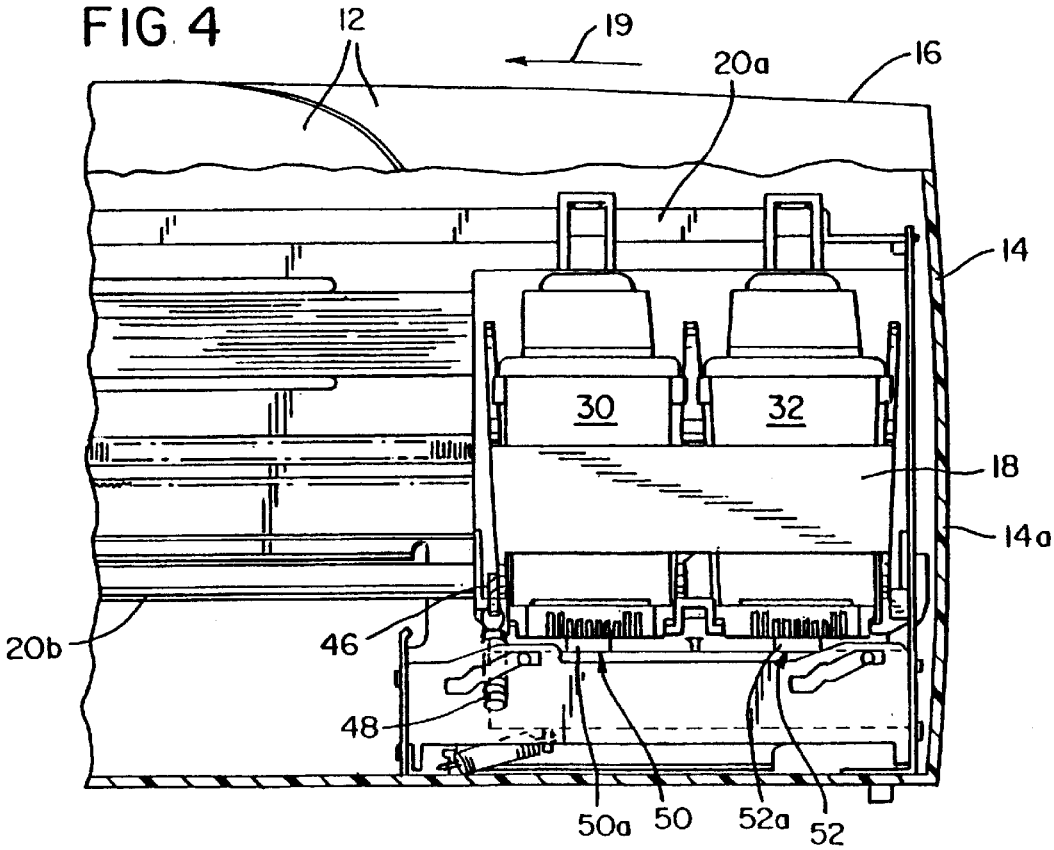
FIG. 4 is a view taken along section line 4—4 in FIG. 2 and with the packaging element removed.
Figure 5:
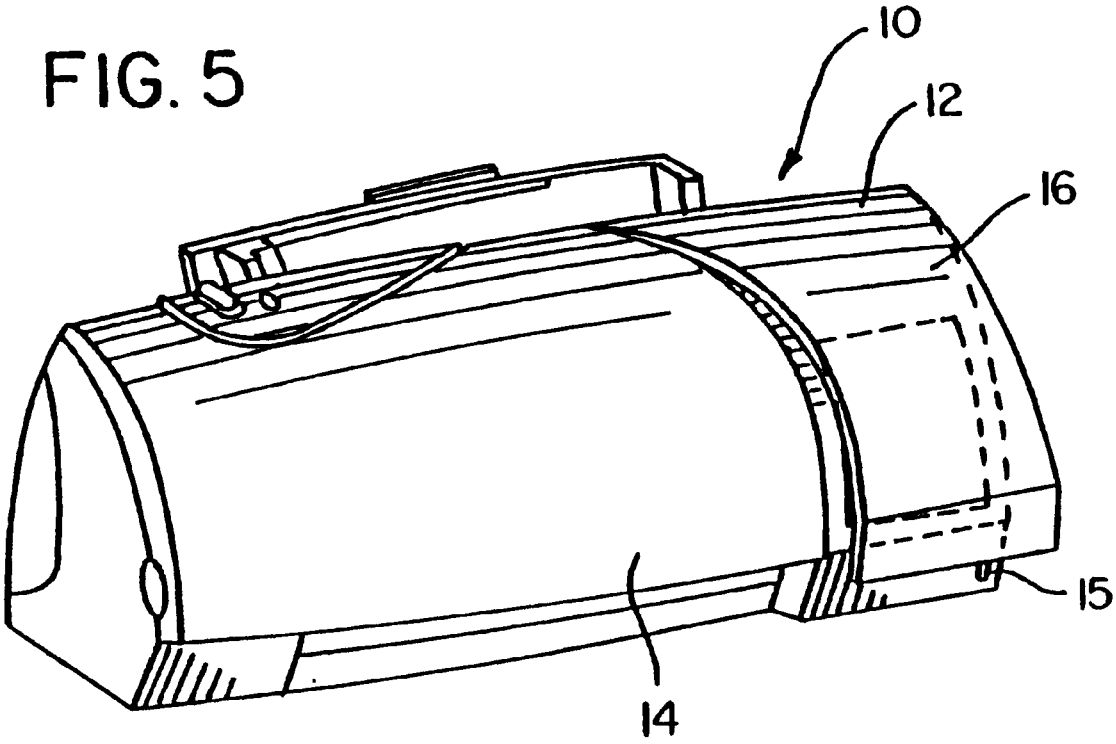
FIG. 5 is a perspective view of the printer illustrated in FIG. 1 with the packaging element removed.

A carrier 18 is slidably supported within the housing 12 on first and second guide rails 20*a* and 20*b*, see FIGS. 3 and 4. A drive mechanism (not shown) is provided for effecting reciprocating movement of the carrier 18 back and forth along the guide rails 20*a* and 20*b*. In the illustrated embodiment, a pair of print cartridges 30 and 32 are removably mounted within the carrier 18 so as to move with the carrier 18. As the print cartridges 30 and 32 reciprocate within the housing 12, they eject ink droplets onto a substrate (not shown) provided below them. The carrier 18 and the print cartridges 30 and 32 define a cartridge assembly 180.

The printer 10 comprises first and second maintenance stations 50 and 52 provided with capping elements 50*a* and 52*a*, see FIG. 4. When the print cartridges 30 and 32 are located directly over the maintenance stations 50 and 52 and the printer 10 is off, the capping elements 50*a* and 52*a* engage the print cartridges 30 and 32 and sealingly surround nozzle plates (not shown) forming part of the print cartridges 30 and 32. The capping elements 50*a* and 52*a* seal the nozzle plates from atmosphere so as to prevent evaporation and coagulation of ink at the nozzle plates. In the illustrated embodiment, the print cartridges 30 and 32 are positioned in a desired position directly over the maintenance stations 50 and 52 when the carrier 18 is positioned adjacent a first side wall 14*a* of the stationary portion 14, see FIG. 4.

The printer 10 further comprises a holding mechanism 40 for maintaining the carrier 18 and, hence, the print cartridges 30 and 32, in the position illustrated in FIG. 4 when the movable housing portion 16 is in its second position. The holding mechanism 40 comprises a stationary arm 42 fixedly mounted to the stationary housing portion 14, a cam 44 fixedly mounted to the movable housing portion 16, a lever 46 (also referred to herein as a locking element) pivotally coupled to the stationary arm 42, and a spring 48 coupled between an extension 14*b* of the stationary housing portion 14 and the lever 46. The cam 44 effects movement of the lever 46 such that it engages the carrier 18 when the movable housing portion 16 is moved from its first position to its second position, see FIG. 2. The lever 46 is considered A engaged@ with the carrier 18 when it makes direct contact with the carrier 18 or is positioned a small distance from the carrier 18. When engaged with the carrier 18, the lever 46 acts as a stop to prevent movement of the carrier 18 in a direction, represented by arrow 19 in FIG. 4, away from the first side wall 14*a*. The lever 46 disengages the carrier 18 when the movable housing portion 16 is permitted to move to its first position, see FIGS. 3 and 5.

Figure 1:
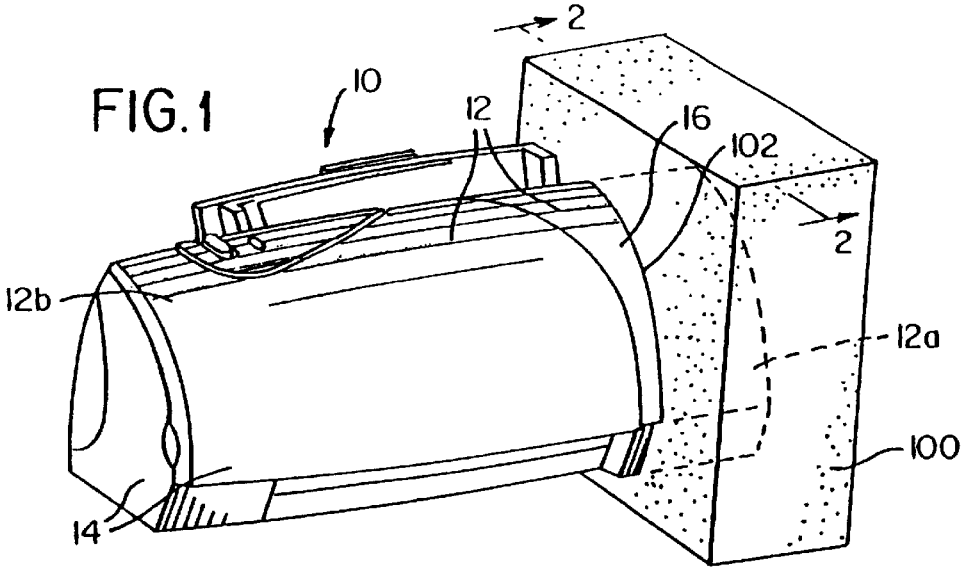
FIG. 1 is a perspective view of a printer constructed in accordance with a first embodiment of the present invention with a packaging element fitted over a first end of the printer housing.
Figure 2:
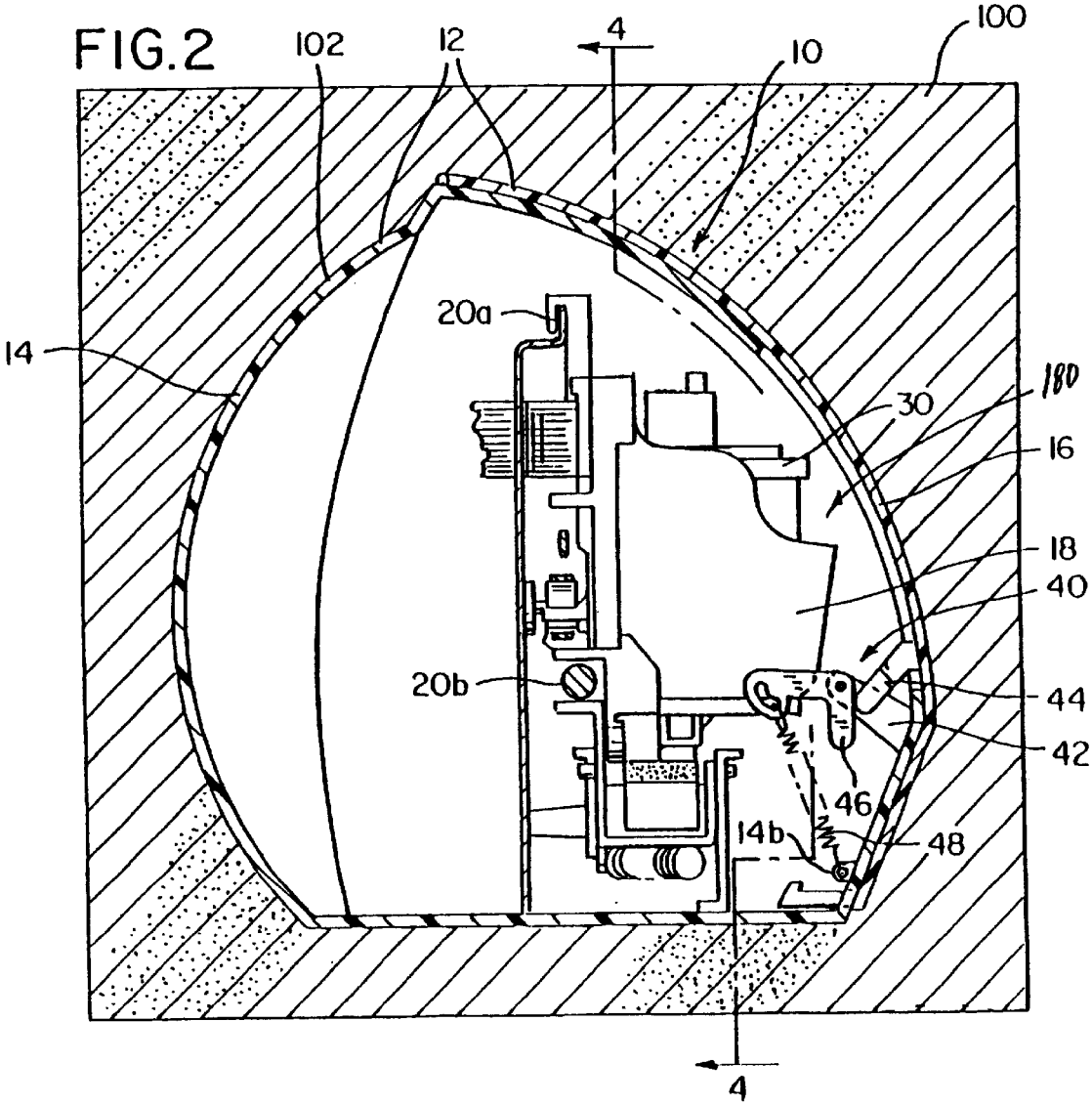
FIG. 2 is a view taken along section line 2—2 in FIG. 1.

A packaging element 100, formed, for example, from expanded polymeric beads, is fitted over a first end 12*a* of the printer housing 12 to maintain the movable housing portion 16 in its second position, see FIGS. 1 and 2. The packaging element 100 comprises a recess 102 shaped so as to receive the first end 102 of the housing 12 when the movable housing portion 16 is in its second position. Once fitted over the first end 102, the packaging element 100 applies a compressive force to the movable housing portion 16 overcoming the biasing force of the spring 48.

When the movable housing portion 16 is in its second position, the lever 46 engages the carrier 18 to maintain the print cartridges 30 and 32 positioned directly over the maintenance stations 50 and 52. Hence, the printer 10 can be shipped with the print cartridges 30 and 32 installed in the printer 10, i.e., with the cartridges 30 and 32 mounted within the carrier 18, without risk that ink will evaporate or coagulate at the nozzle plates. While not shown in the illustrated embodiment, a second packaging element may be fitted over a second end 12*b* of the printer housing 12. Other packaging elements not explicitly set out herein may be used in place of packaging element 100 illustrated in FIGS. 1 and 2. For example, a band may be provided about the first end 12*a* so as to maintain the movable housing portion 16 in its second position.

The movable housing portion 16 comprises a first end 16*a* pivotally coupled to the stationary housing portion 14, a second end 16*b* located opposite the first end 16*a* and a retainer 16*c* at the second end 16*b*. The retainer 16*c* is integral with the second end 16*b* in the embodiment illustrated in FIGS. 2 and 3, and extends through an opening 15 in the stationary housing portion 14, see FIG. 5. When a packaging element 100 is not fitted over the first end 12*a*, the retainer 16*c* engages a lower section 14*c* of the stationary housing portion 14 so as to maintain the second end 16*b* of the movable housing portion 16 spaced a desired distance from the stationary housing portion 14.

After the printer 10 is purchased by an end user, the user must remove the packaging element 100 and any other packaging material from the printer 10 prior to operating the printer 10. When the packaging element 100 is removed from the first end 12*a*, the spring 48 biases the lever 46 to its disengaged position and the movable housing portion 16 to its first position. The end user does not have to install print cartridges into the printer prior to first use of the printer 10.

Figure 2A:
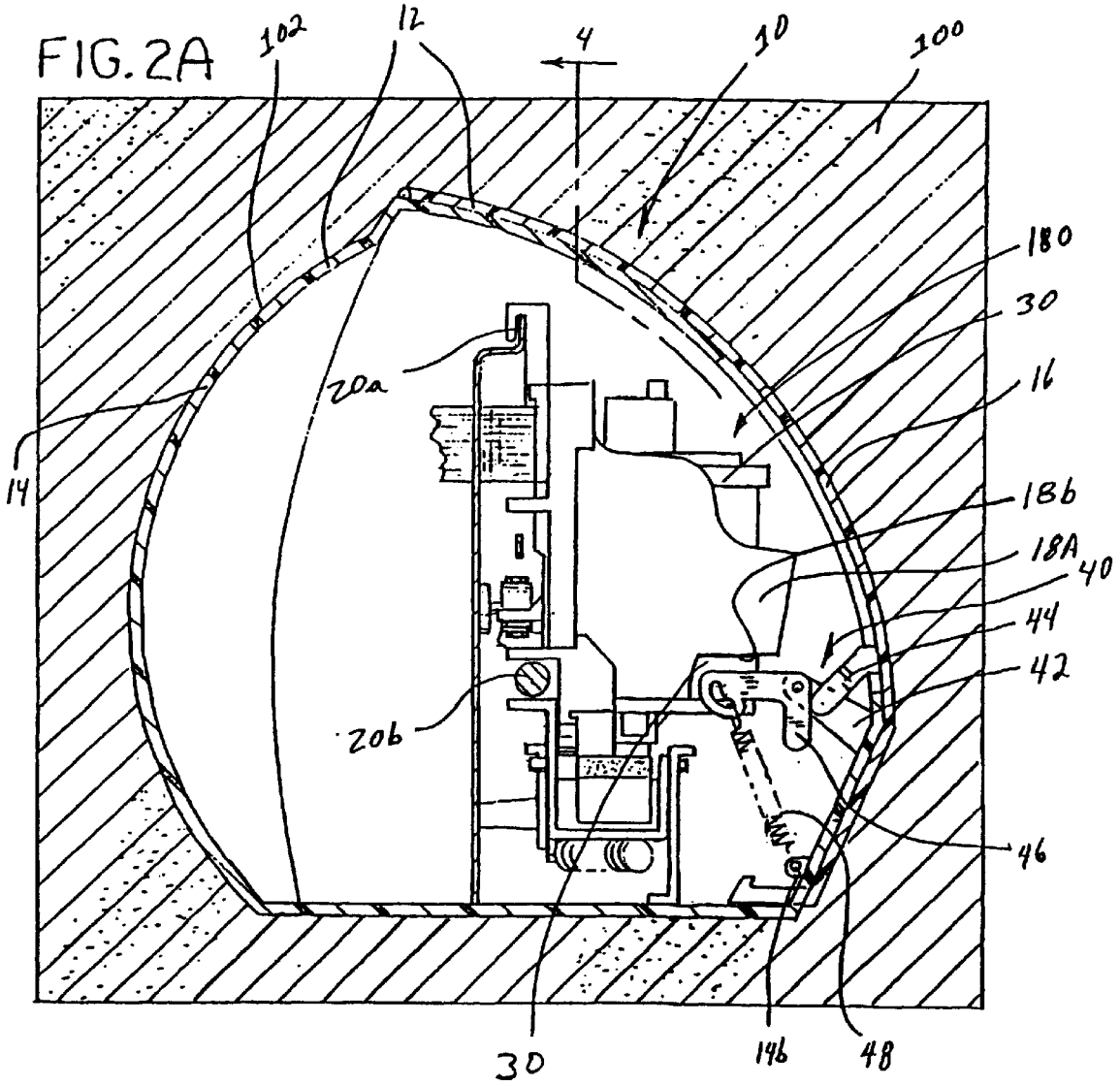
FIG. 2A is a view similar to FIG. 2 but showing an alternative embodiment where a lever contacts a print cartridge directly.

In an alternative embodiment illustrated in FIG. 2A, where like elements are referenced by like numerals, carrier 18A is shown having an opening 18*b* in its lower portion so as to allow the lever 46 to directly engage the print cartridge 30, rather than the carrier 18A, when the movable housing portion 16 is moved from its first position, discussed above, to its second position, shown in FIG. 2A. Alternatively, the lever 46 and the stationary arm 42 may be positioned such that the lever 46 directly engages an intermediate or upper portion of the print cartridge 30.

Figure 6:
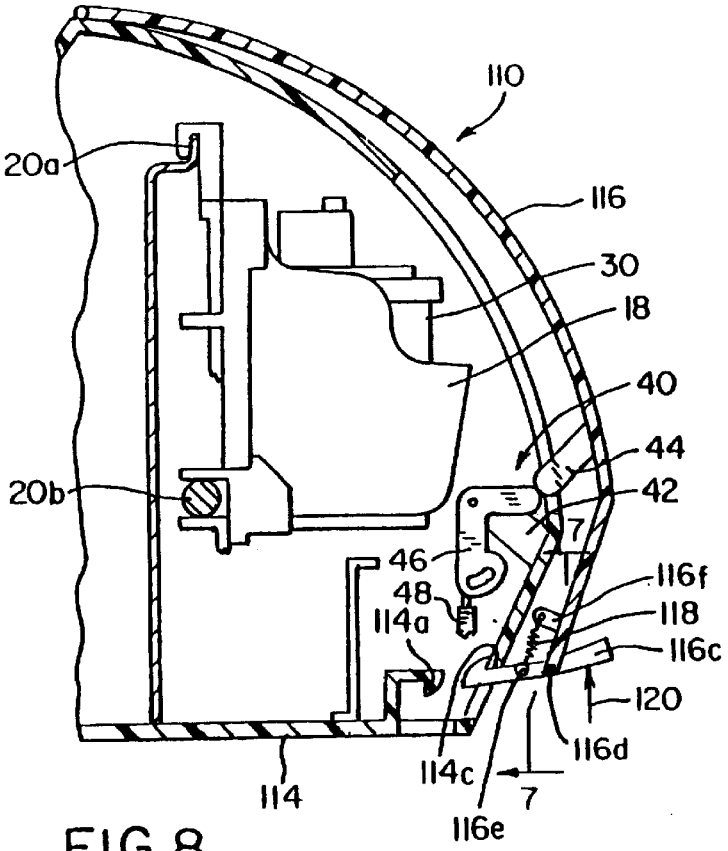
FIG. 6 is a cross sectional view of a portion of a printer constructed in accordance with a second embodiment of the present invention.
Figure 7:
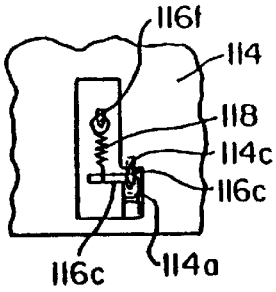
FIG. 7 is a view taken along view line 7—7 in FIG. 6.

A printer 110, constructed in accordance with a second embodiment of the present invention, is shown in FIGS. 6 and 7, wherein like reference numerals indicate like elements. In this embodiment, the retainer 116*c* is pivotally coupled to the movable housing portion 116 via a pin 116*d*. A spring 118 extends from a pin 116*e* on the retainer 116*c* to an extension 116*f* of the movable housing portion 116 so as to bias the retainer 116*c* in a clockwise direction, as viewed in FIG. 6. The retainer 116*c* releasably engages a latch 114*a* coupled to the stationary housing portion 114 when the movable housing portion 116 is moved to its second position. The engagement of the retainer 116*c* with the latch 114*a* maintains the movable housing portion 116 in its second position. The retainer 116*c* is released from the latch 114*a* when a force is applied to the retainer 116*c* in the direction of arrow 120 in FIG. 6. The force causes the retainer 116*c* to pivot away from the latch 114*a*. Once the retainer 116*c* is released from the latch 114*a* and as the movable housing portion 116 moves to its first position, the pivoting force is removed. The spring 118 then causes the retainer 116*c* to move in a clockwise direction, as viewed in FIG. 6, such that the retainer 116*c* is capable of engaging a lower section 114*c* of the stationary housing portion 114. Engagement of the retainer 116*c* with the lower section 114*c* maintains the movable housing portion 116 in its first position, see FIG. 6. In this embodiment, a packaging element is not required to maintain the movable housing portion 116 in its second position as engagement of the retainer 116*c* with the latch 114*a* performs this function.

Figure 8:
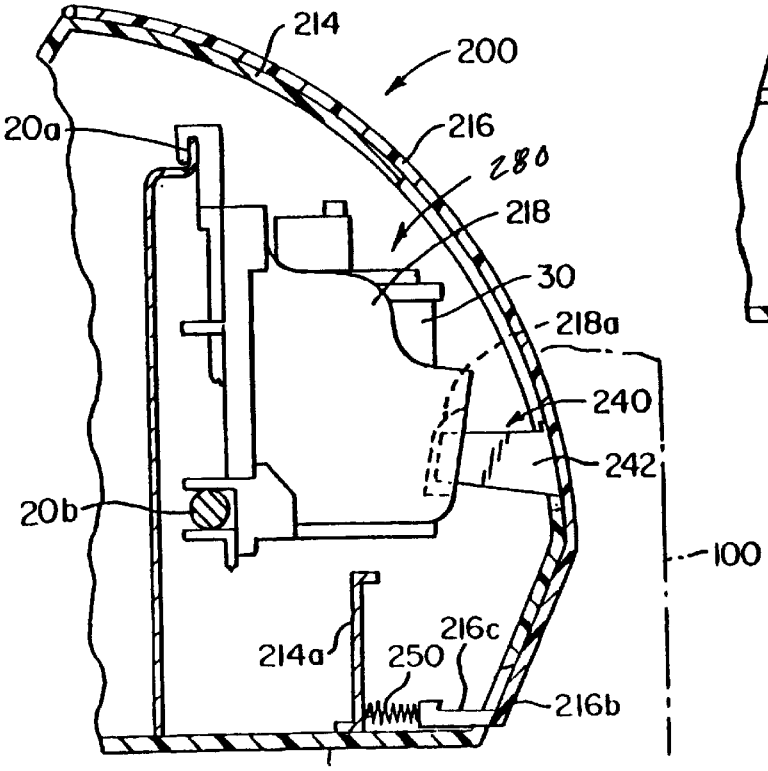
FIG. 8 is a cross sectional view of a portion of a printer constructed in accordance with a third embodiment of the present invention with the movable housing portion shown in its second position.
Figure 9:
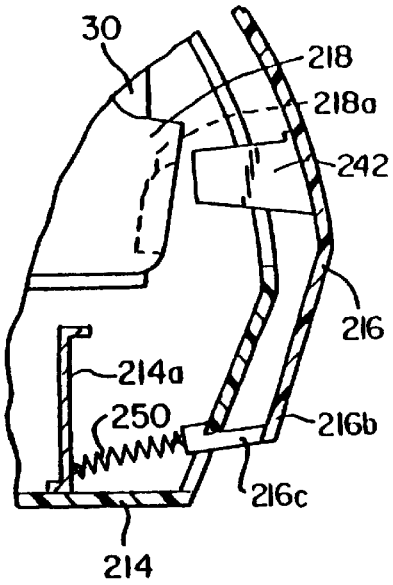
FIG. 9 is a cross sectional view of a portion of the printer illustrated in FIG. 8 with the movable housing portion shown in its first position.

A printer 200, constructed in accordance with a third embodiment of the present invention, is shown in FIGS. 8 and 9, wherein like reference numerals indicate like elements. In this embodiment, the holding mechanism 240 comprises a retaining arm 242 fixedly coupled to the movable housing portion 216. When the movable housing portion 216 is in its second position, shown in FIG. 8, the retaining arm 242 engages a recess 218*a* provided in the carrier 218 so as to maintain the carrier 218 and the print cartridges 30 and 32 positioned over the maintenance stations 50 and 52. A packaging element 100 fitted over the first end 12*a* of the printer housing 12 maintains the movable housing portion 216 in its second position. The carrier 218 and the print cartridges 30 and 32 define a cartridge assembly 280.

A stop 214*a* is coupled to the stationary housing portion 214. A compression spring 250 extends between the stop 214*a* and the retainer 216*c* at the second end 216*b* of the movable housing portion 216 for biasing the movable housing portion 216 to its first position when the packaging element 100 is removed, see FIG. 9.

Figure 8A:
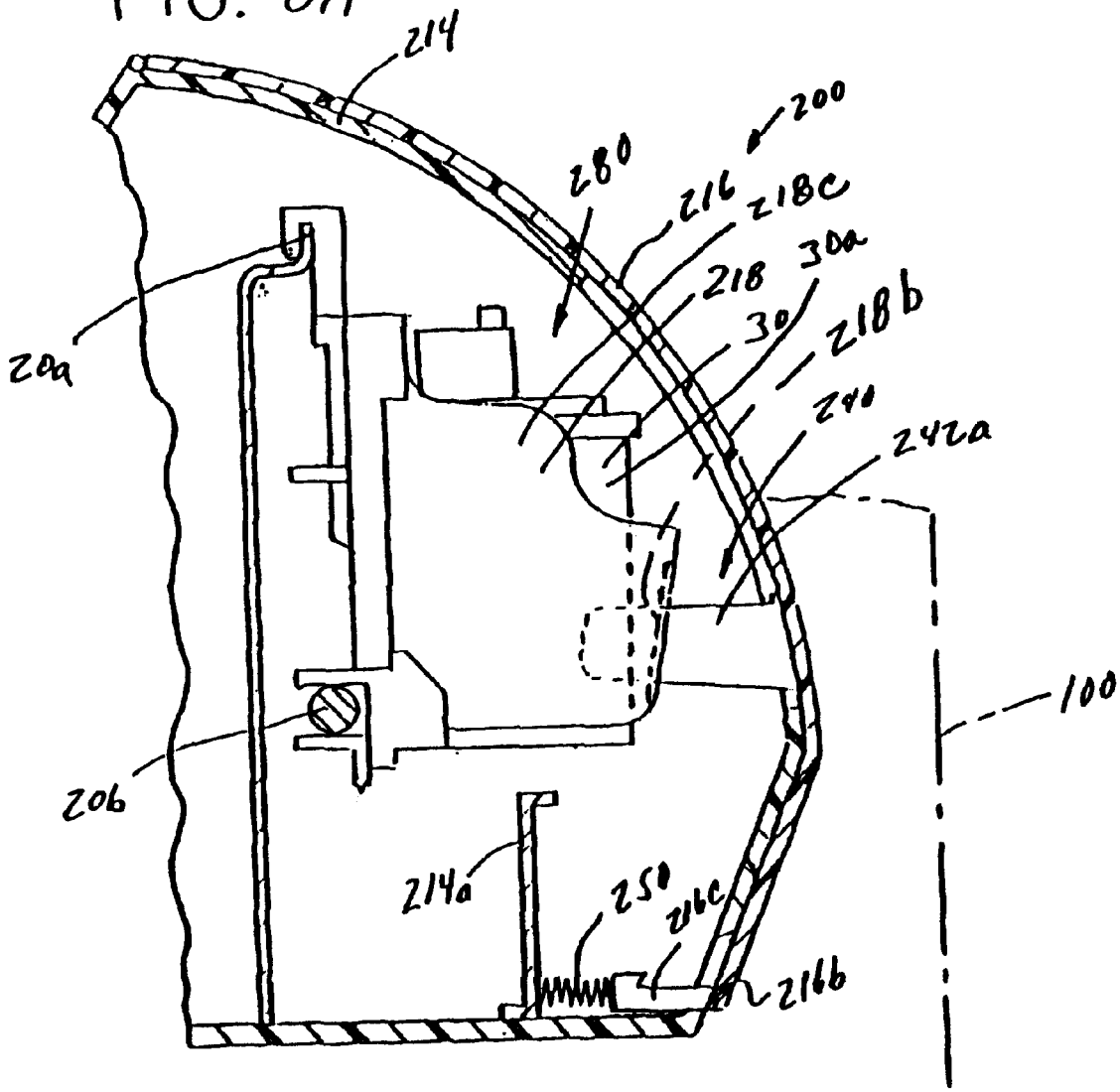
FIG. 8A is a view similar to FIG. 8 but showing an alternative embodiment where a retaining arm contacts a print cartridge directly.

In an alternative embodiment, illustrated in FIG. 8A, where like elements are referenced by like numerals, the retaining arm 242*a*, which is fixedly coupled to the movable housing portion 216, extends through an opening 218*b* in the carrier 218 and directly engages a side wall 30*a* of the print cartridge 30 when the movable housing portion 216 is in its second position, as shown in FIG. 8A. Hence, the arm 242*a* is positioned between the print cartridge side wall 30*a* and a side wall 218*c* of the carrier 218. Alternatively, the retaining arm 242*a* may extend through another opening (not shown) in the carrier 218 so as to directly engage the print cartridge 32.

Figure 10:
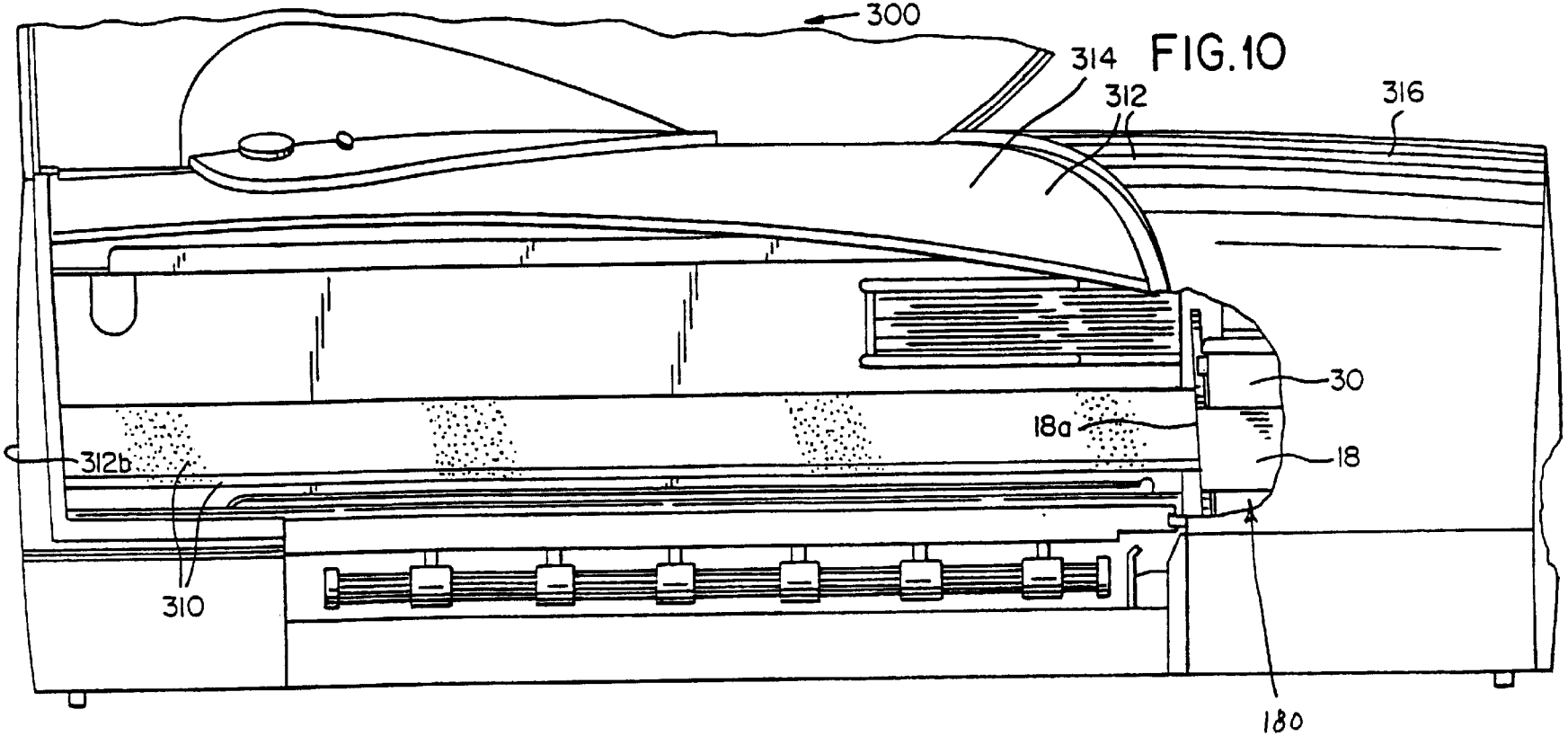
FIG. 10 is a front view of a portion of a printer constructed in accordance with a fourth embodiment of the present invention.
Figure 11:
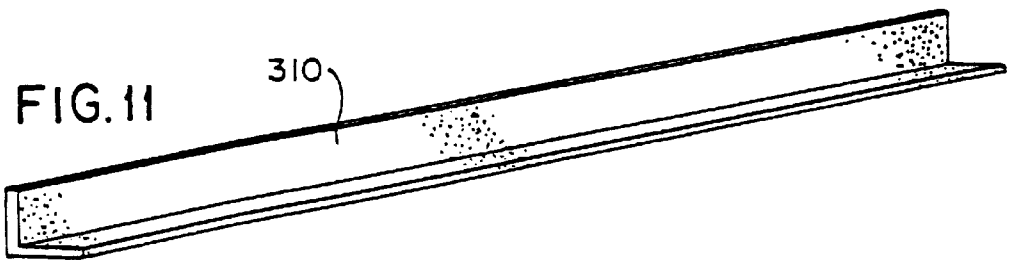
FIG. 11 is a perspective view of the positioning element shown in FIG. 10.

A printer 300, constructed in accordance with a fourth embodiment of the present invention, is shown in FIGS. 10 and 11, wherein like reference numerals indicate like elements. In this embodiment, both of first and second housing portions 314 and 316 are stationary. In order to maintain the carrier 18 and the print cartridges 30 and 32 positioned over the maintenance stations 50 and 52 during shipping, a removable positioning element 310 is inserted into the printer housing 312 so as to be positioned between a second side wall 312*b* of the first housing portion 314 and a side wall 18*a* of the carrier 18, see FIG. 10. The positioning element 310 is preferably formed from a material selected from the group consisting of cardboard, wood, metal, a polymeric material and combinations thereof. The shape of the positioning element 310 may be varied from that of the illustrated embodiment. For example, it may be circular or rectangular in cross section. It may have another shape so long as it has sufficient strength to maintain the carrier 18 and print cartridges 30 and 32 positioned over the maintenance stations 50 and 52 during shipping.

Figure 10A:
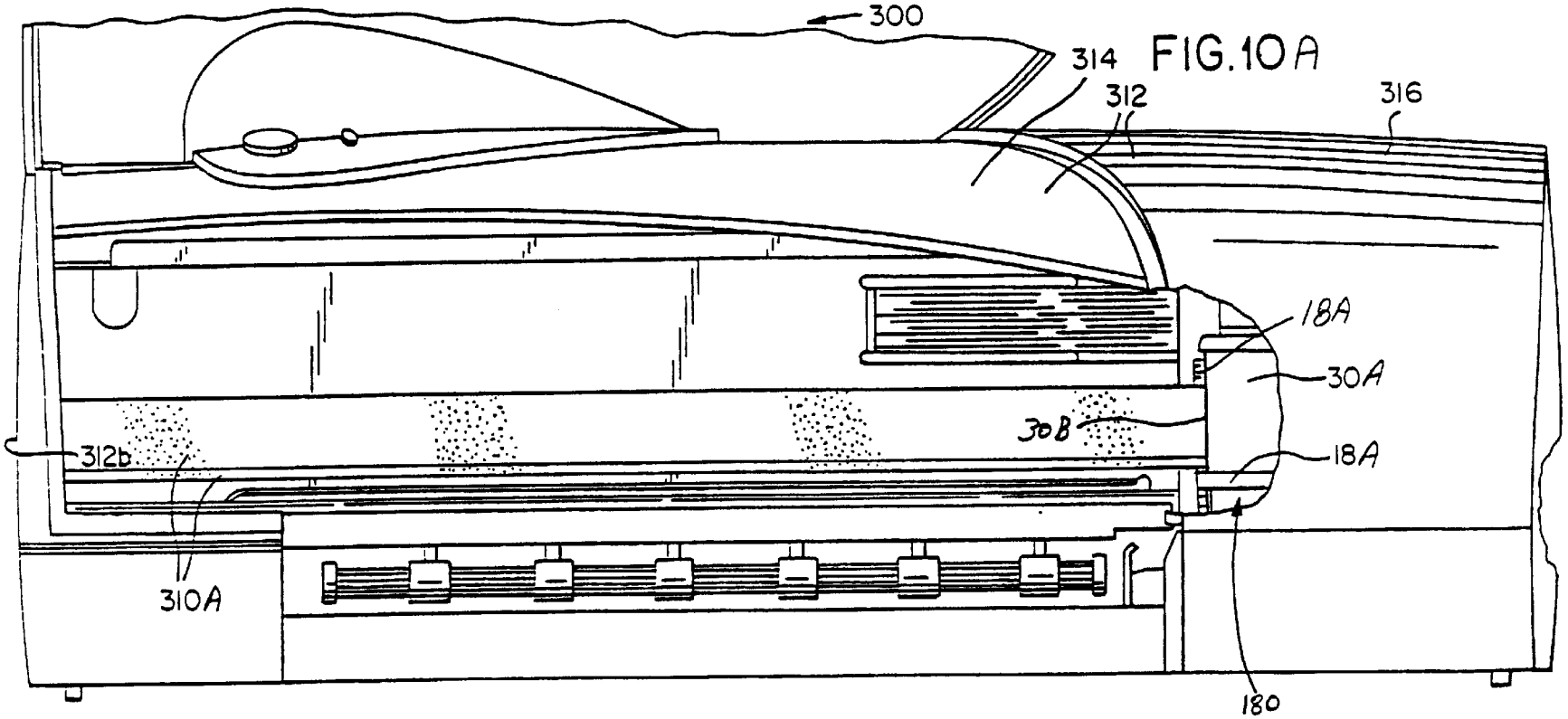
FIG. 10A is a view similar to FIG. 10 but showing an alternative embodiment where a positioning element contacts a print cartridge directly.

In an alternative embodiment illustrated in FIG. 10A, where like elements are referenced by like numerals, a removable positioning element 310A is shown inserted into the printer housing 312 so as to be positioned between a second side wall 312*b* of the first housing portion 314 and a side wall 30B of the print cartridge 30A, which is positioned in the carrier 18A. The positioning element may be formed from the same materials from which the positioning element 310, illustrated in FIG. 11, is formed. It may also have the same shape as the positioning element of the FIG. 11 embodiment.

It is also contemplated that the holding mechanism may engage both print cartridges or both a print cartridge and the carrier so as to maintain the print cartridges positioned over the maintenance stations during shipping.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A printer comprising:

a housing having a stationary portion and a movable portion movable between a first position and a second position;

a carrier movably mounted within said housing;

at least one print cartridge removably mounted within said carrier;

a holding mechanism comprising a retaining arm fixedly coupled to said movable housing portion, said retaining arm being adapted to engage said print cartridge when said movable housing portion is in its second position and to disengage said print cartridge when said movable housing portion is in its first position, said retaining arm maintaining said carrier and said print cartridge in a desired position within said housing when said retaining arm engages said print cartridge; and wherein said movable housing portion comprises a first end pivotally coupled to said stationary housing portion, a second end located opposite said first end and a retainer at said second end, said retainer engaging a section of said stationary housing portion so as to maintain said second end spaced a desired distance from said stationary housing portion when said movable housing portion is in its first position.

2. A printer as set forth in claim 1, wherein said retaining arm is positioned between said carrier and said print cartridge.

3. A printer as set forth in claim 1, further comprising a spring positioned between a stop of said stationary housing portion and said retainer for biasing said retainer and said movable housing portion away from said stationary housing stop.

4. A printer as set forth in claim 1, wherein said housing further comprises a maintenance station, said carrier and said print cartridge being located over said maintenance station when in said desired position.

5. A printer comprising:

a housing having a stationary portion and a movable portion movable between a first position and a second position;

a carrier movably mounted within said housing;

at least one print cartridge removably mounted within said carrier; and a holding mechanism comprising a retaining arm fixedly coupled to said movable housing portion, said retaining arm being adapted to engage said carrier when said movable housing portion is in its second position and to disengage said carrier when said movable housing portion is in its first position, said retaining arm maintaining said carrier and said print cartridge in a desired position within said housing when said retaining arm engages said carrier; and wherein said movable housing portion comprises a first end pivotally coupled to said stationary housing portion, a second end located opposite said first end and a retainer at said second end, said retainer engaging a section of said stationary housing portion so as to maintain said second end spaced a desired distance from said stationary housing portion when said movable housing portion is in its first position.

6. A printer as set forth in claim 5, wherein said retaining arm engages a recess in said carrier.

7. A printer as set forth in claim 5, further comprising a spring positioned between a stop of said stationary housing portion and said retainer for biasing said retainer and said movable housing portion away from said stationary housing stop.

8. A printer as set forth in claim 5, wherein said housing further comprises a maintenance station, said carrier and said print cartridge being located over said maintenance station when in said desired position.

9. A printer in combination with a packaging element comprising:

a housing having a stationary portion and a movable portion movable between a first position and a second position;

a cartridge assembly including a carrier movably mounted within said housing and at least one print cartridge removably mounted within said carrier;

a holding mechanism comprising a retaining arm fixedly coupled to said movable housing portion, said retaining arm being adapted to engage said cartridge assembly when said movable housing portion is in its second position and to disengage said cartridge assembly when said movable housing portion is in its first position; and a packaging element engaging said stationary and movable housing portions and maintaining said movable housing portion in its second position.

10. A printer in combination with a packaging element as set forth in claim 9, wherein said retaining arm engages said carrier when said movable housing portion is in its second position and said retaining arm disengages said carrier when said movable housing portion is in its first position.

11. A printer in combination with a packaging element as set forth in claim 10, wherein said retaining arm engages a recess in said carrier.

12. A printer in combination with a packaging element as set forth in claim 12, wherein said retainer arm engages said at least one print cartridge when said movable housing portion is in its second position and said retaining arm disengages said at least one print cartridge when said movable housing portion is in its first position.

13. A printer in combination with a packaging element as set forth in claim 12, wherein said retaining arm is positioned between said carrier and said print cartridge.

14. A printer in combination with a packaging element as set forth in claim 9, wherein said housing further comprises a maintenance station, said carrier and said print cartridge being located over said maintenance station when in a desired position.

15. A printer in combination with a packaging element as set forth in claim 9, wherein said packaging element comprises a recess adapted to receive an end of said housing.

16. A printer in combination with a packaging element as set forth in claim 9, wherein said movable housing portion comprises a first end pivotally coupled to said stationary housing portion, a second end located opposite said first end and a retainer at said second end, said retainer engaging a section of said stationary housing portion so as to maintain said second end spaced a desired distance from said stationary housing portion when said movable housing portion is in its first position.

17. A printer in combination with a packaging element as set forth in claim 16, further comprising a spring positioned between a stop of said stationary housing portion and said retainer for biasing said retainer and said movable housing portion away from said stationary housing stop.

* * * * *